United States Patent [19]

Martinez

[11] 4,263,387

[45] Apr. 21, 1981

[54] LITHOGRAPHIC PRINTING PLATE AND PROCESS FOR MAKING SAME

[75] Inventor: Ferdinand Martinez, Belmont, Mass.

[73] Assignee: Coulter Systems Corporation, Bedford, Mass.

[21] Appl. No.: 887,189

[22] Filed: Mar. 16, 1978

[51] Int. Cl.[3] ..... G03G 13/32

[52] U.S. Cl. ..... 430/49; 430/94; 430/302; 430/309; 101/454; 101/458; 101/465; 101/467

[58] Field of Search ..... 96/33, 1.5; 430/309, 430/302, 49, 94; 101/454, 458, 465, 467

[56] References Cited

U.S. PATENT DOCUMENTS

| | | | |
|---|---|---|---|
| 3,046,117 | 7/1962 | Sus | 96/33 |
| 3,547,627 | 12/1970 | Amidon et al. | 96/1 |
| 3,658,523 | 4/1972 | Noe | 430/49 |
| 3,970,455 | 7/1976 | Nadeau et al. | 96/33 |
| 4,015,986 | 4/1977 | Paal et al. | 96/33 |
| 4,025,339 | 5/1977 | Knehnle | 96/1.5 |

*Primary Examiner*—Edward C. Kimlin
*Assistant Examiner*—John L. Goodrow
*Attorney, Agent, or Firm*—Silverman, Cass & Singer, Ltd.

[57] ABSTRACT

A method of preparing a lithographic printing plate, and the resulting printing plate, by applying an acidified oxidizing agent such as aqueous potassium permanganate solution to the toned electrostatic latent image on the photoconductive layer of an electrophotographic member to define water-receptive non-printing areas. The thus treated surface may be washed or further treated with conventional ferrocyanide ion containing fountain solutions or gum arabic, but only if desired.

12 Claims, No Drawings

LITHOGRAPHIC PRINTING PLATE AND PROCESS FOR MAKING SAME

REFERENCE TO RELATED APPLICATIONS

Reference is made, and made a part hereof, to U.S. Pat. No. 4,025,339 dated May 24, 1977 for details regarding the film product preferably converted by the method herein to form the disclosed lithographic printing plate.

Reference also is made to and made a part hereof pending applications Ser. No. 632,590 filed Nov. 17, 1975 now abandoned and Ser. No. 656,162 filed Feb. 9, 1976 now abandoned owned by the assignee hereof and concerning other modes of forming lithographic printing plates utilizing the same film product referenced above.

BACKGROUND OF THE INVENTION

Lithographic printing is a well known art. In lithography a printing master or plate is employed having a printing surface on which the printing image areas are ink receptive whereas the non-printing background areas are water receptive. During printing, a generally conventional aqueous so-called "fountain solution" is applied to the printing surface of the plate. The fountain solution wets only the water receptive background areas. An oil based ink then is subsequently or simultaneously applied to the printing surface of the plate and is repelled from the background areas, adhering only to the printing image areas. The printing plate is applied directly to paper printing image areas, as known in so-called direct printing or as in offset lithography, the inked printing plate applied to a rubber blanket onto which the image is applied, with the rubber blanket then contacting a paper for transfer of the image thereon.

Lithographic printing plates can be prepared by electrophotographic imaging.

Typically in one electrostatic imaging process a lithographic printing plate is prepared by employing a conventional electrophotographic printing element such as for instance a selenium plate. The plate is charged and exposed to an image pattern. There follows the step of developing such image pattern by attraction thereto of electroscopic toner powder which is ink receptive. There follows transferral to a water receptive plate such as treated paper, grained aluminum and the like. The toner is fused by solvent vapour or heat to form ink receptive printing areas thereon.

A lithographic printing plate can be prepared by developing with ink receptive toner the latent electrostatic image carried by a sheet having a photoconductive zinc oxide coating contained within an insulating resinous binder material. Such coating is generally water repellent. After toning the remaining bare water repellent surface (of the non-imaged areas) is then rendered water receptive by the application of so-called conventional conversion solutions.

Notwithstanding the advantages of the above methods of lithographic printing plate preparation, certain disadvantages are encountered in conventional processes. For instance, in an electrostatic process cited wherein a lithographic plate is prepared by transfer of ink receptive powder deposit onto a water receptive substrate, image resolution is limited by the relatively large particle size of the developing powder and image detail may be lost during the powder image transfer step. Where a binder type electrophotographic plate is employed, the resulting plate has relatively short run life, reducing the number of copies obtainable from such plate to a few hundred to a few thousand copies. Other methods require relatively lengthy preparation procedures and/or long exposure times. In addition, expense of the resulting plates is a factor.

The pending applications Ser. Nos. 632,590 and 656,162 deal with coatings which are applied selectively to the photoconductive layer surface to render the covered areas hydrophilic. A chromic acid compound resulting from application of acidified chromic ion is suggested. While successful, however, some aspects lead to disadvantage as to marketability. These include the anti-environmental impact of chromium compounds and their toxicity which deter their use.

The application of selectively located physically held coatings has been suggested. These also have been successful. Nonetheless, other alternatives that are effective, long lasting, inexpensive, etc. are desired. It is believed that the invention herein provides such alternative with even greater advantage than heretofore available.

SUMMARY OF THE INVENTION

Accordingly, the invention provides an electrophotographic printing element which preferably has a conductive substrate which has deposited thereon a photoconductive layer consisting of a fully crystalline inorganic photoconductive substance such as, for instance, cadmium sulfide. The photoconductive layer is free of any binder material and is ink receptive. A method of forming lithographic printing plate by forming toned imaged areas on the photoconductive layer of an electrophotographic plate and rendering the non-imaged areas water receptive by application thereto of an oxidizing agent having an oxidization potential higher than chromate ion, such as, for example, acidic aqueous potassium permanganate; the non-imaged areas being converted to hydrophilize said surface. The treated surface may be washed or treated with a ferrocyanide ion solution or wiped with gum arabic. The gum arabic coating is removed just prior to placing of the plate upon the press.

DESCRIPTION OF PREFERRED EMBODIMENTS

The electrophotographic member from which the printing plate herein preferably is formed by the method of this invention includes a conductive substrate and an inorganic photoconductive coating on said conductive substrate such as provided in U.S. Pat. No. 4,025,339. A flexible substrate, say of polyethylene glycol terphalate, having a conductive layer of indium-tin oxide sputter deposited thereupon can serve as the conductive substrate, the indium-tin oxide layer having a thickness of about 300 Angstroms, the proportions of indium oxide to tin oxide being about nine to one, respectively. This conductive layer functions as an aid to charging, is transparent to visible light and does not impair the flexibility of the substrate. The layer of a photoconductive material, such as cadmium sulfide is applied on the conductive layer.

In one example, the photoconductive layer is a deposit about 3500 angstroms thick of uniformly-sized and closely packed highly oriented crystalline cadmium sulfide (CdS). Other photoconductive materials which have been deposited successfully by the same method to form the convertible member for preparing the printing plate of this invention include zinc sulfide (ZnS) and mixtures of zinc sulfide and cadmium sulfide, and others mentioned in the referenced patent.

The first step in the method of the invention is the formation of an electrophotographic member carrying a toned electrostatically applied image using electroscopic toner particles to define the printing or hydrophobic areas of the printing plate. The toned photoconductive layer may be rinsed in clear dispersant after toning if desired, and also may be pre-rinsed before toning to prevent absorption of toner particles to the background or non-printing areas. The toned image deposit on the photoconductive layer may be fused thereon.

The toner particle deposits in the printing image areas protect the underlying photoconductive layer from attack during the subsequent step of conversion of the non-printing areas to a water-wettable surface. The toner particle deposits should be free of voids through which the conversion solution could penetrate and contact the underlying photoconductive layer. Fusible toners are employed, such as those of the self-fusing type.

The deposits formed by the toner particles constitute the ink receptive printing areas of the resultant printing plate subsequent to "conversion" of the non-printing areas. Less strongly adhering toner particles can be used, as well, but after the conversion process is completed, the protective cover offered by said toner particles is removed. Now, the underlying photoconductive layer itself functions as the ink receptive printing area.

According to the invention, the conversion of the background or non-printing areas to effect the hydrophilic property is to treat the toned members with an acidified oxidizing agent such as an aqueous acidified potassium permanganate solution.

The above disclosed process of conversion in accordance with this invention, that is of treating the photoconductive layer with the aqueous potassium permanganate solution which has been acidified with sulfuric or phosphoric acid and can be carried out conveniently by immersion of the toned member, is followed by rinsing either with clear water or with a fountain solution containing acidified or alkaline ferrocyanide ion.

The following example will further illustrate the principles of this invention.

An electrophotographic member was prepared as described in U.S. Pat. No. 4,025,339 having a polyester substrate, an indium-tin oxide ohmic layer of about 300 Angstroms applied to the substrate and a photoconductive coating formed of microcrystalline cadmium sulfide r.f. sputter deposited upon the ohmic layer of about 3000 Angstroms thickness. A visible electrostatic latent image was produced on the surface of the photoconductive coating.

After toning the surface of the photoconductive layer was heated to fuse the toner deposits.

An aqueous acidified potassium permanganate solution was prepared by mixing equal amounts of 0.015 molar potassium permanganate and 0.0075 molar sulfuric acid, a 2:1 molar ratio of permanganate to surfuric acid. The toned member was immersed in the resulting permanganate-sulfuric acid solution for four seconds. The member then was rinsed.

The observed result was that the image-free surface areas of the photoconductive coating of said treated member were rendered water receptive satisfactory for lithographic printing. The toner covered areas remained unaffected and ink receptive. The measured pH of the treating solution was found to be 2.90±0.05 at 70° F. The relative concentration of permanganate ion and sulfuric acid solution can be increased by a factor of at least 20 with satisfactory results. There should not be an excess of free sulfuric acid so that the sulfuric acid-permanganate relationship using the minimum end may result in a substantial increase in the time required for treatment. The higher the permanganate concentration, the more buildup of manganese dioxide.

The preparation of the printing plate as described, can be carried out in a relatively short time as each of the exposing, toning, toner deposit fusing and conversion steps requires time of the order of seconds only. In addition the photoconductive layer consisting of fully crystalline inorganic substance deposited by the sputtering process as hereinbefore described is characterized by a high degree of light sensitivity, and this allows the printing plate to be exposed in a camera if so desired and then toned and thereafter fused. Thus, when said lithographic plate formed in accord with the invention herein is employed, the printing run can commence within a few minutes of the start of plate preparation.

I claim:

1. A method of making a direct-imaged flexible printing plate suitable for use in offset or the like lithographic printing from an electrophotographic member having a substrate and a high gain, sensitive, electrically anisotropic, photoconductive coating deposited upon the substrate which coating is sputtered, wholly inorganic, microcrystalline, generally uniformly oriented vertically relative to the surface of the substrate, having light transmissivity of at least 70 percent, having a dark resistivity of at least $10^{12}$ ohm - centimeters and a ratio between dark and light resistivity of at least about $10^4$, electrically anisotropic, flexible, transparent, dense and has an abrasion-resistant surface, which method comprises: charging the surface of the electrophotographic member in darkness, immediately thereafter exposing the surface to a radiation projected image to form a latent image of charge on said surface, toning the surface to develop the latent image with a hydrophobic toner and thereafter applying an acidic aqueous solution of an oxidizing agent having an oxidation potential higher than the chromate ion to the toner surface whereby to impart to the surface only of the non-imaged areas a hydrophillic coating maintaining the sub-surface of the said areas as well as the imaged areas intact and hydrophobic.

2. The method as claimed in claim 1 in which the toner is fused to the surface before the application of the oxidizing agent.

3. The method as claimed in claim 1 in which the toned image is removed from the surface after treating with the oxidizing agent.

4. The method as claimed in claim 1 in which the oxidizing agent is the permanganate ion.

5. The method as claimed in claim 4 in which an aqueous ferrocyanide ion solution is applied to the surface of the photoconductive layer after application of the permanganate ion to the said surface.

6. The method as claimed in claim 4 in which the acid selected for use with the permanganate ion is selected from the group sulfuric and phosphoric acids.

7. The method as claimed in claim 4 in which the mole ratio of permanganate ion to acid is about 2:1.

8. A lithographic printing plate comprising, in combination, an electrophotographic member having a conductive substrate and a high gain, sensitive, photoconductive coating upon the conductive substrate which coating is sputtered, wholly inorganic, microcrystalline, generally uniformly oriented vertically relative the surface of the substrate, having light transmissivity of at least 70 percent, having a dark resistivity of at least $10^{12}$ ohm - centimeters and a ratio between dark and light resistivity of at least about 104, electrically anisotropic, flexible, transparent dense and has an abrasion resistant surface, an image on said latter surface providing imaged and non-imaged areas on said surface, said imaged areas being hydrophobic, the surface of non-imaged areas having been treated with an oxidizing ion having an oxidation potential higher than that of chromate ion whereby said treated non-imaged surface areas only are hydrophilic with the integrity of the sub-surface and imaged areas maintained.

9. A printing plate as claimed in claim 8 in which the toned image areas are toned with a hydrophobic toner and same is permanently adhered to said surface.

10. A printing plate as claimed in claim 8 in which the photoconductive coating is cadmium sulfide.

11. A printing plate as claimed in claim 9 in which the oxidizing ion is the permanganate ion.

12. A printing plate as claimed in claim 8 in which the printing areas comprise the photoconductive surface.

* * * * *